US005303725A

United States Patent [19]

Hilgren

[11] Patent Number: 5,303,725

[45] Date of Patent: Apr. 19, 1994

[54] MACHINE PART CLEANING APPARATUS

[75] Inventor: Wallace L. Hilgren, Edina, Minn.

[73] Assignee: Kleer-Flo Company, Eden Prairie, Minn.

[21] Appl. No.: 19,036

[22] Filed: Feb. 18, 1993

[51] Int. Cl.[5] ..... B08B 3/02; B08B 13/00

[52] U.S. Cl. ..... 134/56 R; 134/104.4; 134/107; 134/111; 134/113

[58] Field of Search ..... 134/56 R, 104.4, 105, 134/107, 111, 113, 186, 191, 195, 198, 199, 200

[56] References Cited

U.S. PATENT DOCUMENTS

| | | | |
|---|---|---|---|
| 1,545,979 | 7/1925 | Rosenberg . | |
| 1,826,015 | 10/1931 | Morton . | |
| 2,646,585 | 7/1953 | Whittington . | |
| 3,020,918 | 2/1962 | Albertson et al. . | |
| 3,522,814 | 8/1970 | Olson | 134/111 |
| 4,056,114 | 11/1977 | Boutillette . | |
| 4,120,547 | 10/1978 | Price et al. . | |
| 4,135,530 | 1/1979 | Cheney | 134/104.4 X |
| 4,505,284 | 3/1985 | Kyatt | 134/111 X |
| 4,543,182 | 9/1985 | Gramse et al. | 134/111 X |
| 4,911,190 | 3/1990 | Sheldon . | |
| 5,107,876 | 4/1992 | Ozyjiwsky | 134/111 |
| 5,232,299 | 8/1993 | Hiss | 134/104.4 X |

FOREIGN PATENT DOCUMENTS

| | | | |
|---|---|---|---|
| 2449056 | 4/1976 | Fed. Rep. of Germany | 134/111 |
| 51591 | 4/1979 | Japan . | |
| 553319 | 5/1943 | United Kingdom | 134/104.4 |

*Primary Examiner*—Philip R. Coe

*Attorney, Agent, or Firm*—Merchant, Gould, Smith, Edell, Welter & Schmidt

[57] ABSTRACT

An aqueous parts cleaning apparatus includes a base defining a liquid-containing volume and a basin sized to be received upon an upper end of said base. The basin has a drain disposed to empty into the volume. A pump is provided for pumping liquid into the basin from the base. A heater is provided for heating liquid within the base. An oil skimming weir is provided for skimming oil off the surface of the solution within the base. A second oil skimming weir is provided for skimming oil from solution contained within said basin.

8 Claims, 3 Drawing Sheets

MACHINE PART CLEANING APPARATUS

BACKGROUND OF THE INVENTION

1. Field of the Invention

This invention pertains to an apparatus for cleaning parts (e.g., machine parts). More particularly, this apparatus pertains to such an apparatus for use with aqueous cleaning solutions.

2. Description of the Prior Art

In the prior art, numerous apparatus are known for cleaning machine parts. An example of such is Product RK30 of Kleer-Flo Company. The Kleer-Flo RK30 device includes a basin which can be fitted on top of a drum. Cleaning solution from the drum is pumped into the basin through a flexible hose.

The prior art devices such as the RK30 were for use with so-called petroleum distillate solvents. Due to environmental concerns, the industry has migrated to use of aqueous cleaning solutions. Such solutions must be heated and need to be cleansed, from time to time, of contaminant oil contained on the parts being cleaned with the apparatus.

SUMMARY OF THE INVENTION

According to a preferred embodiment of the present invention, an aqueous parts cleaning apparatus is disclosed. The apparatus includes a base having sidewalls and a floor defining a liquid-containing volume. A basin is sized to be received upon the upper end of the base with the basin having a drain disposed to empty into the base. A pump is provided having an inlet disposed to receive fluid from within the base. The pump is connected to a flexible hose contained on the basin to discharge fluid from the base into the basin. An aqueous cleaning solution is disposed within the base to obtain a predetermined elevation. A first oil-skimming weir is disposed of within the base approximate the elevation. A drain is provided adjacent the weir to drain oil from the weir. A heating element is provided beneath the base to heat the floor of the base. A second oil skimming weir is disposed within the basin.

DESCRIPTION OF PREFERRED EMBODIMENT

Figure 1:
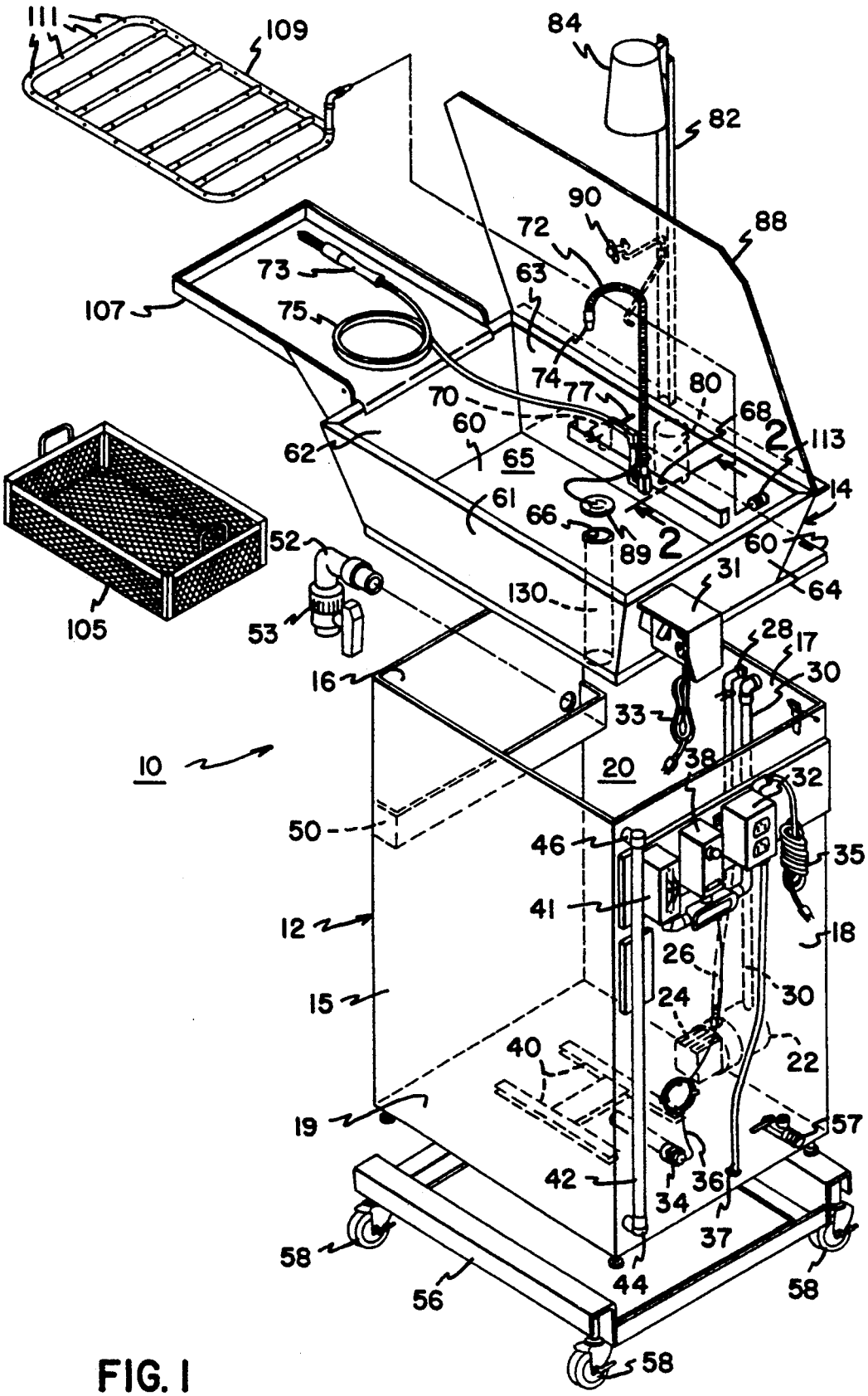
FIG. 1 is an exploded perspective view of a machine parts cleaning apparatus according to the present invention.
Figure 2:
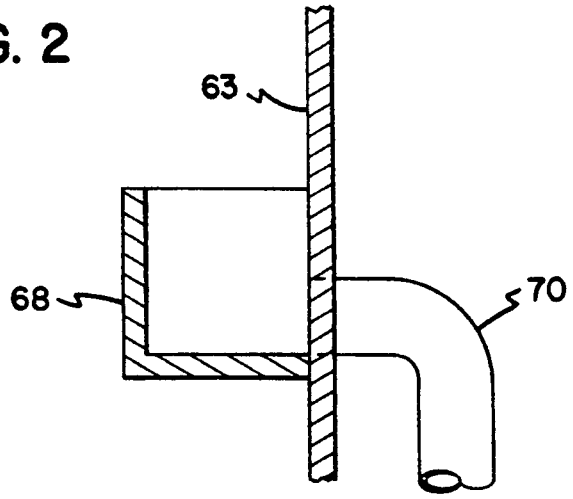
FIG. 2 is a view taken along line 2—2 of FIG. 1.

Referring now to the several drawings and figures in which identical elements are numbered identically throughout, a description of the preferred embodiment will now be provided.

An aqueous parts cleaning apparatus is shown generally as item 10. The apparatus 10 includes a base 12 and a basin 14. The base 12 includes side walls 15–18 and a floor 19 cooperating and to define a base interior 20.

A pump 22 is disposed within the interior 20 with a filtered inlet 24 disposed to receive a solution contained within the base 12. The pump 22 includes an outlet 26 exposed through back wall 17 through coupling 28.

An electrical conduit 30 extends from the pump 22 through the back wall 17 to permit connection of the pump power supply to an outlet 31 carried on the exterior of a side wall 64 of the basin 14. The outlet 31 has a supply cord 33 to be plugged into a ground fault interrupted outlet 32 having cord 35 to plug to any wall outlet. A thermocouple 34 projects through side wall 18 near the bottom of interior 20 and is connected via a conductor 36 to a thermostat 38 contained on the exterior of wall 18.

Electrically energized strip heaters 40 are secured to the floor 19 on the undersurface of the floor 19. Conductors 37 provide energy for the strip heaters 40. A switch 41 energizes heaters 40. Since the base 12 is formed of stainless steel, heating of the strip heaters 40 heats the floor 19.

A fluid level sight tube 42 is provided with a first inlet 44 adjacent the base 19 and a second outlet 46 adjacent the top of the base. The tube 42 is transparent to permit observation of a fluid level within the tube indicating a fluid level within the interior 20 of the base 12.

An aqueous cleaning solution is contained within the base 12. The cleaning solution attains a predetermined level 102 (FIG. 4) of elevation when no fluid is drawn from base 12 to basin 14.

A first oil skimming weir 50 is disposed within the base 12 and secured to the interior of wall 16 at the level of elevation. A drain 52 having a valve 53 extends through the wall 16 and into the weir 50 to permit drawing of oil from the weir 50. A drain 57 is provided at the base of base 12 to permit emptying of fluid from the base 12. An optional support platform 56 is provided to receive the base with casters 58 contained on the support to permit movement and placement of the apparatus 10 in any desired location.

Figure 4:
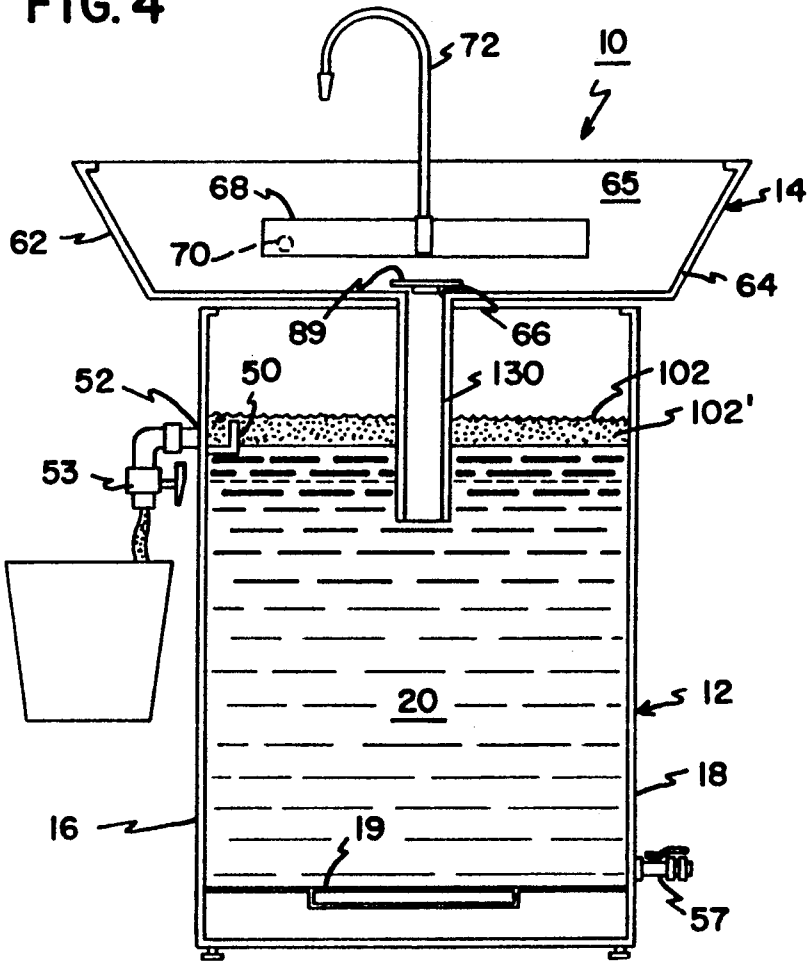
FIG. 4 is a front sectional schematic view of the apparatus.

The basin 14 has a bottom plate 60 sized to cover and rest upon the base 12. The basin 14 further includes side walls 61–64 cooperating to define a basin interior 65. A drain 66 is formed through bottom plate 60 to permit draining of fluid from the interior 65 into the interior 20 of the base 12. A stopper 89 is provided to close drain 66. A drain tube 130 is connected to drain 66. Tube 130 has a length sufficient to drain fluid from basin 14 into base 12 beneath fluid level 102 as shown in FIG. 4.

A second oil skimming weir 68 is secured to the interior of the basin on wall 63. A weir overflow tube 70 extends through wall 63 and plate 60 and communicates with the interior 20 to skim oil and fluid from basin 14 into base 12.

A flexible hose 72 is secured to the wall 63 and has a nozzle 74. Piping connects the hose 72 through a connector to the coupling 28. A filter 80 is disposed within the piping to filter fluid passing from the coupling 28 to the hose 72. Tube 70 and hose 72 are mutually sized for flow through tube 70 and hose 72 to be approximately equal.

As an option, a brush 73 is connected to hose 72 through a flexible hose 75 and valve 77. Also shown as an option, a parts cleaning basket 105 is provided sized to be received within basin 14. A removable shelf 107 is optionally secured to side wall 62. Finally, as an option, an air agitation manifold 109 is received within basin 14. The manifold is a series of hollow pipes with air discharge holes 111 (only some of which are shown in FIG. 1). The manifold 109 is connected to a quick connect coupling 113 mounted on wall 63. Coupling 113 is connected to a source (not shown) of compressed air.

A lamp support 82 is secured to the wall 63 and carries a work lamp 84. Work lamp 84 is connected through a cable to the outlet 31.

A cover 88 is hinged to the wall 63. In the down position, the cover 88 covers the basin interior 65. In the up position, the cover 88 permits access to the interior 65. Cover 88 may be retained in the up position by securing the cover to the support 82 via a releasable latch 90.

In a preferred embodiment, latch 90 is a low melting point metal. Referred to in the art as a fusible link, latch 90 retains cover 88 in a normally open position. In the event of fire, latch 90 melts permitting cover 88 to drop and deprive the basin of oxygen to prevent fire spreading.

Figure 3:
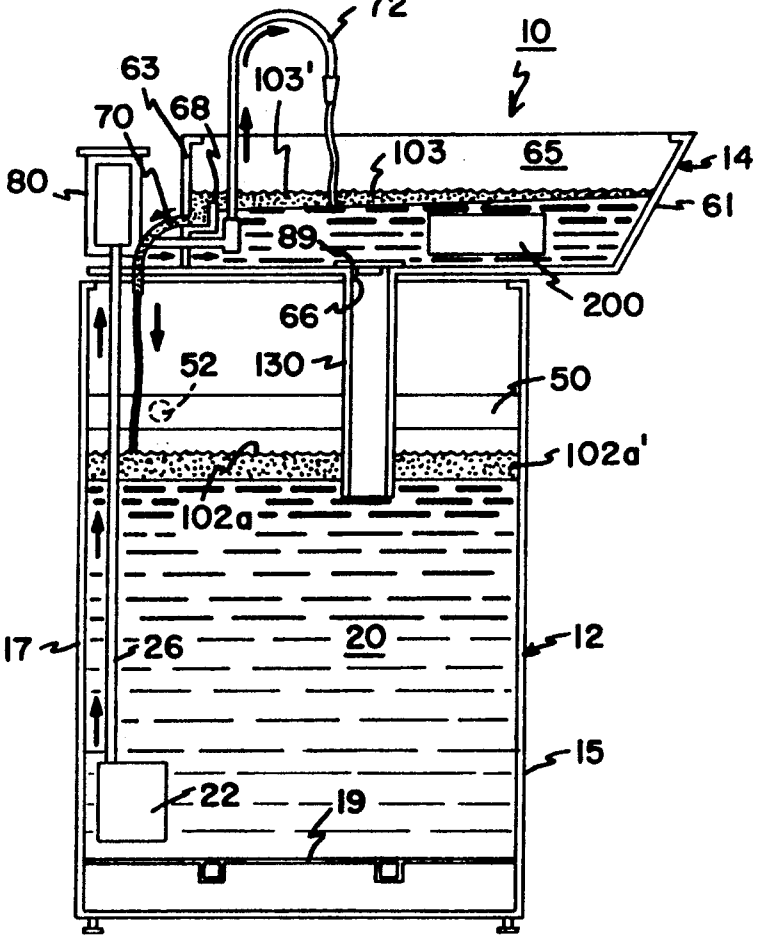
FIG. 3 is a side sectional schematic view of the apparatus.

In operation, aqueous solution is placed within the base 12 to achieve the desired level 102. The basin 14 is secured on the top of the base 12. Parts to be cleaned are placed within the basin 65. The operator permits cleaning fluid to be injected into the basin 65 via nozzle 74 to clean the parts. With a plug 89 inserted within drain 66, cleaning solution fills the basin until a level 103 (FIG. 3) equal to the position of the weir 68 is attained. This lowers the level of fluid in base 12 to a new level 102*a* (FIG. 3).

Since oils from the machine parts will float to the surface 103 of the cleaning surface, oils are skimmed over the top of the weir 68 and discharged through weir overflow 70. Similarly, oil which may be returned to the base floats to the top of the base and may be skimmed off through weir 50 and discharged through drain 52 (see FIG. 4). The strip heaters 40 on the base 19 heat the cleaning solution to a desired temperature as determined by thermostat 38. Placement of the strip heaters 40 on the floor 19 insures that the fluid level 102*a* never goes below the strip heaters 40 to prevent damage to the strip heaters 40.

With the prior art approach, (e.g., the Kleer Flo RK30), no drain plug is provided in the upper basin. Instead, a flow is provided to the basin and constantly discharged into a lower drum. The prior art product simply used the basin as a catch basin. There was no use or suggestion for a soaking of parts. Also, and since the product used petroleum distillates solvents, there was no suggestion for a weir to maintain a constant level with a skimming layer (since the oil cleaned from the parts would not separate from the solvents).

The present invention permits a level 103 of cleaning fluid to remain in basin 14. A part 200 (FIG. 3) to be cleaned of oil is submerged in the basin (preferably in basket 105). Cleaning is enhanced by agitator 109 or scrubbing brush 73. A constant flow of fresh cleaning solution from base is added through hose 72 while the pump 22 is running.

As shown best in FIGS. 3 and 4, oil from part 200 floats to surface 103 to form a layer 103' of mixed oil and cleaning fluid. The oil and cleaning fluid layer 103' is skimmed off of surface 103 by weir 68. Tube 70 discharges the skimmed oil and fluid layer 103' from basin 14 into base 12. Since tube 70 and hose 72 are mutually sized to provide similar volumetric flows, the level 103 remains constant while pump 22 is running.

When fluid from basin 14 is discharged into base 12, drain tube 130 ensures the drained fluid from basin 14 is added below level 102*a* to prevent churning and turbulence of an oil level 102*a*' which forms within base 14. The oil level 102*a*' is skimmed from level 102*a* by weir 50 when the drain 89 is open and level 102*a* returns to level 102 (FIG. 4). The placement of pump 22 near floor 19 ensures that oil free fluid is pumped from base 12 to basin 14.

The foregoing operation avoids re-contamination of cleaned parts 200. Namely, if an oil-ladened part 200 is cleaned in an aqueous solution, the oil floats to the surface 103. Upon removal of the part from the solution, the part 200 must pass through the oil level 103' resulting in re-contamination of the part. The present invention minimizes the possibility of such recontamination by skimming oil from surface 103. Further oil is not reintroduced to the basin 14 from the base 12 since oil level 102' is skimmed off as shown in FIG. 4.

In FIG. 4, tube 130 extends beneath level 102'. Therefore, when operating without plug 89, the solution pumped into basin 14 through hose 72 drains directly through tube 130. The drained solution is admitted into base 12 beneath level 102' to prevent entrainment of oil level 102'.

In addition to avoiding recontamination, the present design ensures a supply of heated aqueous cleaning solution virtually free of oil. Heat loss and evaporation of the solution is minimized.

From the foregoing detailed description of the present invention, it has been shown how the objects of the invention have been attained in the preferred embodiment. Modifications and equivalents of the disclosed concepts are intended to be included within the scope of the claims which are appended hereto.

What is claimed is:

1. An aqueous parts cleaning apparatus for cleaning parts contaminated with oil, said apparatus comprising:
   - a base having side walls and a floor joined to define a liquid-containing volume;
   - a basin sized to be received upon an upper end of said base, said basin having a drain disposed to empty into said base when said basin is received upon said base;
   - a pump having an inlet disposed to receive fluid from within said base;
   - an aqueous cleaning solution disposed within said base;
   - a first oil skimming weir disposed within said base having a drain for drawing oil from said weir and out of said base;
   - a heating element disposed to heat said solution within said base;
   - a second oil skimming weir disposed within said basin; and
   - a conduit carried on said basin with means for connecting said conduit to an outlet of said pump to urge fluid from said base through said conduit and into said basin.

2. An apparatus according to claim 1 comprising filter means for filtering flow of fluid from said pump to said conduit.

3. An apparatus according to claim 1 comprising a thermostat for sensing a temperature of a fluid within said base, control means for controlling said heating element in response to said sensed temperature.

4. An apparatus according to claim 1 comprising level indicator means carried on said base for indicating the level of solution within said base.

5. An apparatus according to claim 1 wherein said second weir is connected to discharge into said base.

6. An apparatus according to claim 1 comprising means for retaining fluid in said basin at a predetermined elevation.

7. An apparatus according to claim 6 wherein said second weir is disposed at said elevation.

8. An apparatus according to claim 1 comprising a drain tube secured to said drain and sized to direct fluid from said basin to a location with said base beneath an elevation of said solution within said base.

* * * * *